US010669719B2

(12) United States Patent
Du et al.

(10) Patent No.: US 10,669,719 B2
(45) Date of Patent: Jun. 2, 2020

(54) N-SHAPE PREFABRICATED CONNECTIVE SPLIT COLUMN FOR UNDERGROUND STRUCTURES

(71) Applicant: Beijing University of Technology, Beijing (CN)

(72) Inventors: Xiuli Du, Beijing (CN); Zigang Xu, Beijing (CN); Chengshun Xu, Beijing (CN)

(73) Assignee: Beijing University of Technology, Beijing (CN)

( * ) Notice: Subject to any disclaimer, the term of this patent is extended or adjusted under 35 U.S.C. 154(b) by 298 days.

(21) Appl. No.: 15/747,703

(22) PCT Filed: May 9, 2017

(86) PCT No.: PCT/CN2017/083529
§ 371 (c)(1),
(2) Date: Jan. 25, 2018

(87) PCT Pub. No.: WO2018/068504
PCT Pub. Date: Apr. 19, 2018

(65) Prior Publication Data

US 2020/0087915 A1 Mar. 19, 2020

(30) Foreign Application Priority Data

Oct. 4, 2016 (CN) ..... 2016 1 0895477

(51) Int. Cl.
*E04C 3/34* (2006.01)
*E04B 1/98* (2006.01)

(52) U.S. Cl.
CPC . *E04C 3/34* (2013.01); *E04B 1/98* (2013.01)

(58) Field of Classification Search
CPC ..... E04C 3/34
(Continued)

(56) References Cited

U.S. PATENT DOCUMENTS 1,914,065 A * 6/1933 Bauer ..... E04C 3/34 52/649.6
4,631,892 A * 12/1986 Beck ..... E04C 3/34 405/239

(Continued)

FOREIGN PATENT DOCUMENTS

CN 101519897 A 9/2009
CN 201794167 U 4/2011

(Continued)

*Primary Examiner* — Paola Agudelo
(74) *Attorney, Agent, or Firm* — Zhihua Han; Wen IP LLC

(57) ABSTRACT

An n-shape connected split column for underground structure comprises a prefabricated reinforced concrete column, n-shape connector, exterior packaged steel sheet, reserved connecting reinforcement and reserved high strength bolt. The subject of the prefabricated reinforced concrete column is an ordinary reinforced concrete column; the reserved connecting reinforcement is reserved on the top and bottom of the prefabricated reinforced concrete column; a high strength bolt is reserved on adjacent side faces. The n-shape connector connects with prefabricated reinforced concrete column through reserved high strength bolt; they are installed in underground structure through reserved connecting reinforcement. The exterior packaged steel sheet is pasted on the exterior of the prefabricated reinforced concrete column, and coadjacent prefabricated reinforced concrete column and connection gap between them is overall packaged to ensure the performance of split column under normal service condition. The present disclosure has clear concept and principle; it is easy to be manufactured, repaired, and installed in a key position of underground structure to decrease the damage of earthquake for an underground structure.

7 Claims, 5 Drawing Sheets

(58) Field of Classification Search
USPC ..... 52/834
See application file for complete search history.

(56) References Cited

U.S. PATENT DOCUMENTS 5,263,297 A * 11/1993 Kim ..... E04C 3/34 52/244
6,096,403 A * 8/2000 Wycech ..... B29C 44/1228 428/122
6,123,485 A * 9/2000 Mirmiran ..... E02D 31/02 405/232
6,295,770 B1 * 10/2001 Sheu ..... E04B 1/161 52/167.1
6,832,454 B1 * 12/2004 Iyer ..... E01D 19/125 52/223.1
8,468,775 B2 * 6/2013 Vaughn ..... E02D 27/34 403/200
2006/0117704 A1 * 6/2006 Yoon ..... E04C 3/34 52/834
2009/0057531 A1 * 3/2009 Waite ..... E04C 3/34 249/48
2010/0031605 A1 * 2/2010 Hong ..... E04B 1/30 52/839
2011/0283657 A1 * 11/2011 Barrett ..... E04C 3/34 52/834
2013/0133278 A1 * 5/2013 Kim ..... E04C 3/34 52/223.4
2016/0222643 A1 * 8/2016 Castelli ..... A63H 33/105

FOREIGN PATENT DOCUMENTS

CN 103104038 A 5/2013
CN 104631706 A 5/2015
CN 106499120 A 3/2017
DE 3116102 A1 11/1982

* cited by examiner

N-SHAPE PREFABRICATED CONNECTIVE SPLIT COLUMN FOR UNDERGROUND STRUCTURES

CROSS-REFERENCE TO RELATED APPLICATION

This application is a national stage application of International application number PCT/CN2017/083529, filed May 9, 2017, titled "N-shape prefabricated connective split column for underground structures," which claims the priority benefit of Chinese Patent Application No. 201610895477.X, filed on Oct. 14, 2016, which is hereby incorporated by reference in its entirety.

TECHNICAL FIELD

The present disclosure belongs to the area of construction of the underground structure, especially to a kind of n-shape connected split column for underground structures, and to the area of the earthquake resistant technology of prefabricated subway stations.

BACKGROUND

In recent year, with the development of urbanization process of each country, and utilization of underground space become an important trend in this field. Underground structures are used more and more widely in urban constructions, transportation, national defense constructions, and water conservancy projects such as railway tunnel, subway engineering, underground markets and air defense works. It has been showed that 21$^{st}$ century is the century of development and utilization of underground spaces. Moreover, the development of underground space and construction of the underground structure are in peak hours with fast development all over the world. As for urban traffic, subway engineering as an efficient public transport with large volume plays an important role in solving the problem of transportation. Though development of underground works is booming, it also faces challenges such as an earthquake. Especially in M7.2 Kobe earthquake in Japan 1995, the underground structures were damaged the most in history, and subway, underground parking, underground tunnel, and the underground market are damaged severely. The most remarkable thing is the damage to subway stations, and there is 5 subway station, and 3 km tunnel of the subway are damaged. The most damaged subway station is Daikai station, more than a half of central columns are completely collapsed, and this leads to the slump of top slab and the subsidence of overlying soil. The maximum settlement was 2.5 m. Research shows vertical earthquake may be the important factors to lead underground structures damaged, especially for shallow underground structures in which shear failures may occur in overlying soil at the beginning of an earthquake. At this moment, there is not a continuous entire structure with other soil surrounded the underground structure. In later seismic responses, the top slab of the underground structures may be surrounded, and weak connection heaped soil effect may occur, which is similar to the backfill. Restraint of underground structure and responses to the earthquake are different from the continuous soil. Vertical force evaluation of key support components of underground structures is influenced strongly by vertical inertia force of overlying soil. In fact, the force changes the axial compression ratio of the column, and shear resistance strength and deformation performance of the column are changed. As for the seismic response of the underground structure, increasing of shear resistance strength and decreasing of ultimate deformation performance of central column are disadvantageous. This means that the column will bear larger horizontal shearing force from underground structures caused by soil deformation, while decreasing of ultimate deformation performance may cause column damaged before side walls are broken, resulting in overall damages to the top slab and underground structures.

The present disclosure discloses an n-shape connected split column for underground structures based on seismic hazard features and failure mechanisms of the underground structures; it is used for replacing ordinary cast-in-place reinforced concrete column in traditional underground structure. The prefabricated reinforced concrete column is fully packaged by exterior sheet steel after connecting with the n-shape connector, connection gap between prefabricated reinforced concrete columns is not exposed to ensure the safety of split column; and shear failure of the overlying soil of underground structure is easy to occur under seismic action. Underground structures will bear larger longitudinal impedance load under the action of self-weight and additional vertical inertia force. The split column mentioned above is used to replace an ordinary cast-in-place reinforced concrete column in traditional underground structure to overcome the deficiency of horizontal deformation under high axial compression of ordinary reinforced concrete column in traditional underground structure, while relative deformation between prefabricated reinforced concrete columns drives the shear deformation of n-shape connector and dissipates some of the seismic energy such that key support components of underground structure are prevented from being damaged.

SUMMARY

The present disclosure disclosed a kind of n-shape connected split column for underground structure; it can bear large vertical inertia force of overlying soil during an earthquake, while side deformation performance under high axis compression is improved so that damage of the underground structure during an earthquake is lightened.

To solve the problem mentioned above, the present disclosure disclosed a kind of n-shape connected split column for underground structure; it comprises a prefabricated reinforced concrete column, n-shape connector, exterior packaged sheet steel, reserved connecting reinforcement and reserved high strength bolt.

The subject of prefabricated reinforced concrete column mentioned above is an ordinary reinforced concrete column, reserved connecting reinforcement is set to connect on the top and bottom of it, reserved high strength bolt is set on both adjacent side wall.

Prefabricated reinforced concrete column mentioned above connects with the top and bottom beam of the underground structure through reserved connecting reinforcement to form a stable entirety.

Each 4 or more than 4 high strength bolts mentioned above constitutes a bolt group; bolt group is distributed with an equal interval along with height direction of the prefabricated reinforced concrete column.

The n-shape connector is made of mild steel material with low yield point. It seems like "n" shape, there are bolt holes reserved on both wings of it.

The n-shape connector is installed between two prefabricated reinforced concrete columns through its reserved high strength bolt; this n-shape connector is distributed with equal spacing along the height direction of prefabricated reinforced concrete column, it makes the prefabricated reinforced concrete column connects with each other.

Exterior package sheet steel is made of sheet steel; it is packaged outside the prefabricated reinforced concrete column, connection gap between two prefabricated reinforced concrete columns is entirely packed.

Working principle of the present disclosure is: n-shape connected split column is installed on key position of the underground structure through connecting reinforcement to replace normal cast-in-place concrete column, connecting reinforcement is embedded on the top and bottom of the prefabricated reinforced concrete column. Under normal condition, prefabricated reinforced concrete column and connection gap between them is entirely packaged by exterior package sheet steel to ensure the normal services of split column. When an earthquake occurs, exterior package sheet steel is damaged at first, then, relative deformation between each prefabricated reinforced concrete column leads to relative deformation of the n-shape connector, it dissipates part of earthquake energy. The n-shape connected split column can bear vertical load similar with the traditional poured concrete column, while the n-shape connector will provide large lateral deformation capacity for prefabricated split column under high axial load, the safety of underground key structure (central column) is protected by it. Damage is decreased greatly during an earthquake.

Advantages of the present disclosure are: prefabricated reinforced concrete column and gaps between them are fully packaged in exterior sheet steel. It ensures the working performance of split columns under normal service conditions. Exterior package sheet steel is damaged at first, then, relative deformation between each prefabricated reinforced concrete column leads to relative deformation of the n-shape connector, it dissipates part of earthquake energy. The n-shape connected split column can bear the large vertical load, while it has large lateral deformation capacity, the safety of underground key structure (central column) is protected by it. Damage is decreased greatly during an earthquake.

As in one or more figures above, 1 refers to the prefabricated reinforced concrete column, 2 refers to the n-shape connector, 3 refers to exterior sheet steel, 4 refers to a reserved connecting reinforcement, and 5 refers to a reserved high strength bolt.

DETAILED DESCRIPTION OF THE PREFERRED EMBODIMENTS

Figure 1:
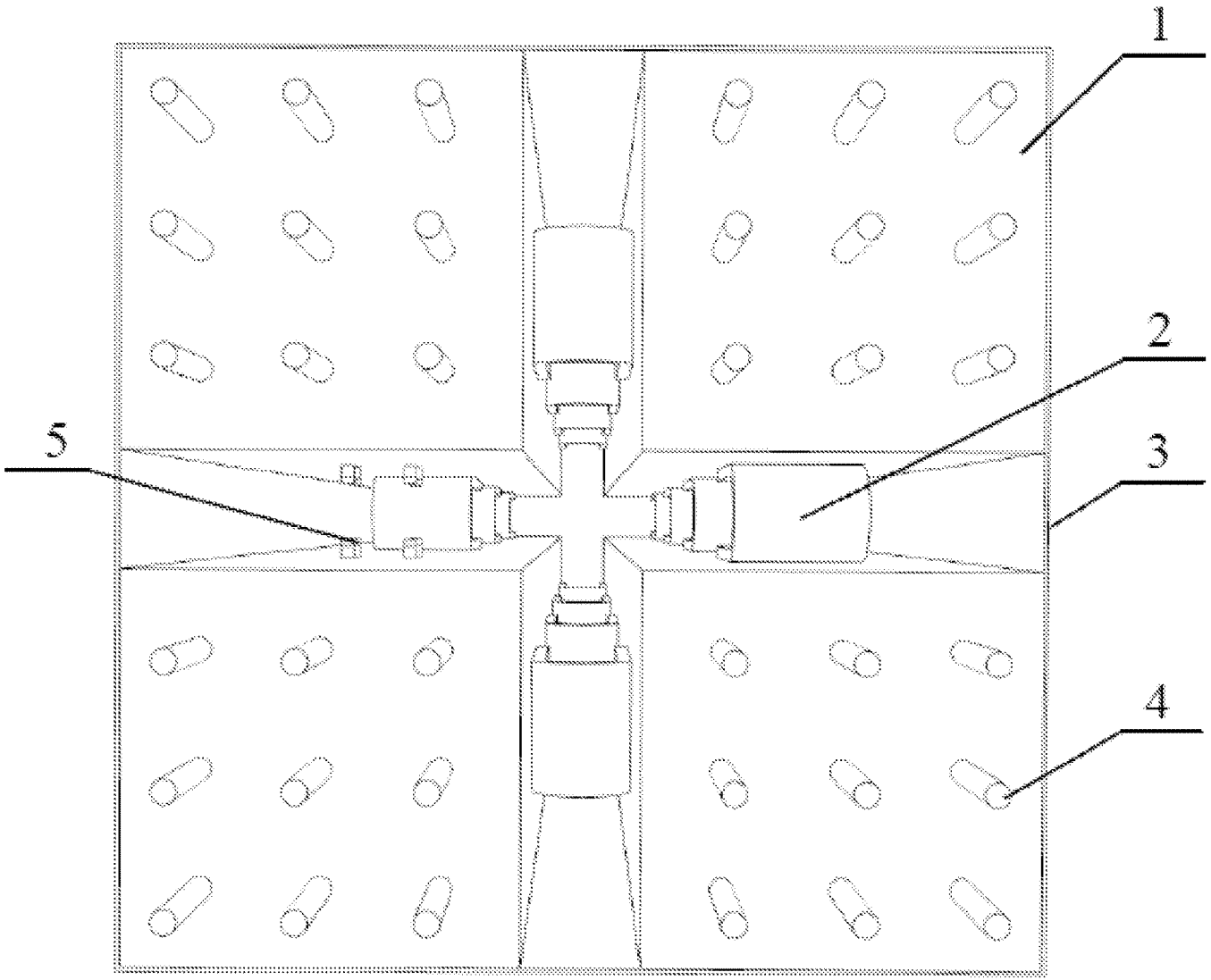
FIG. 1 illustrates top view of n-shape connected split column.
Figure 2:
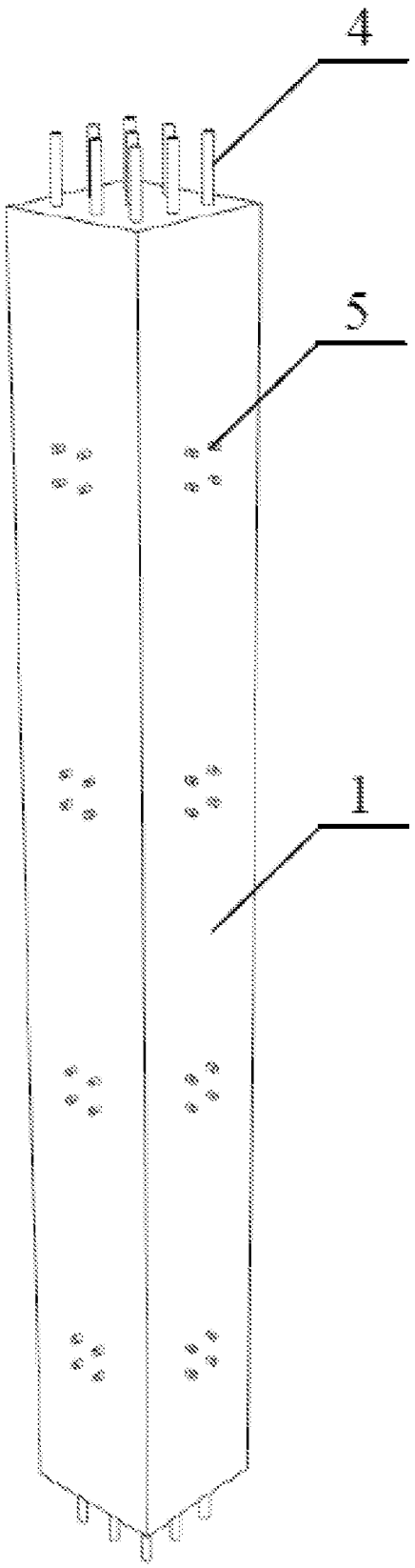
FIG. 2 illustrates prefabricated reinforced concrete column with reserved connecting reinforcement and high strength bolt.
Figure 3:
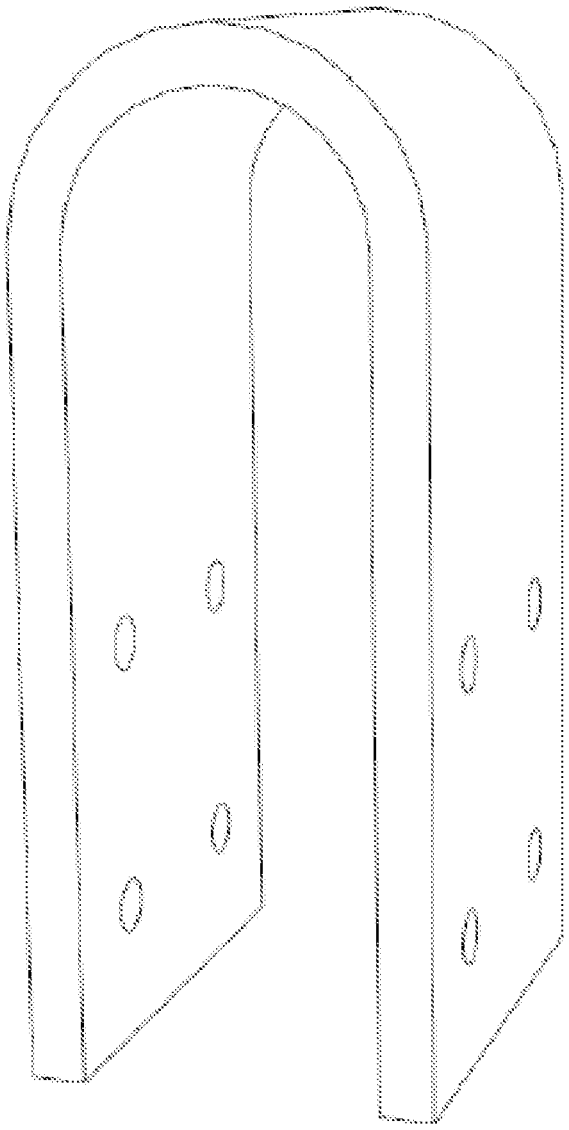
FIG. 3 illustrates n-shape connector.
Figure 4:
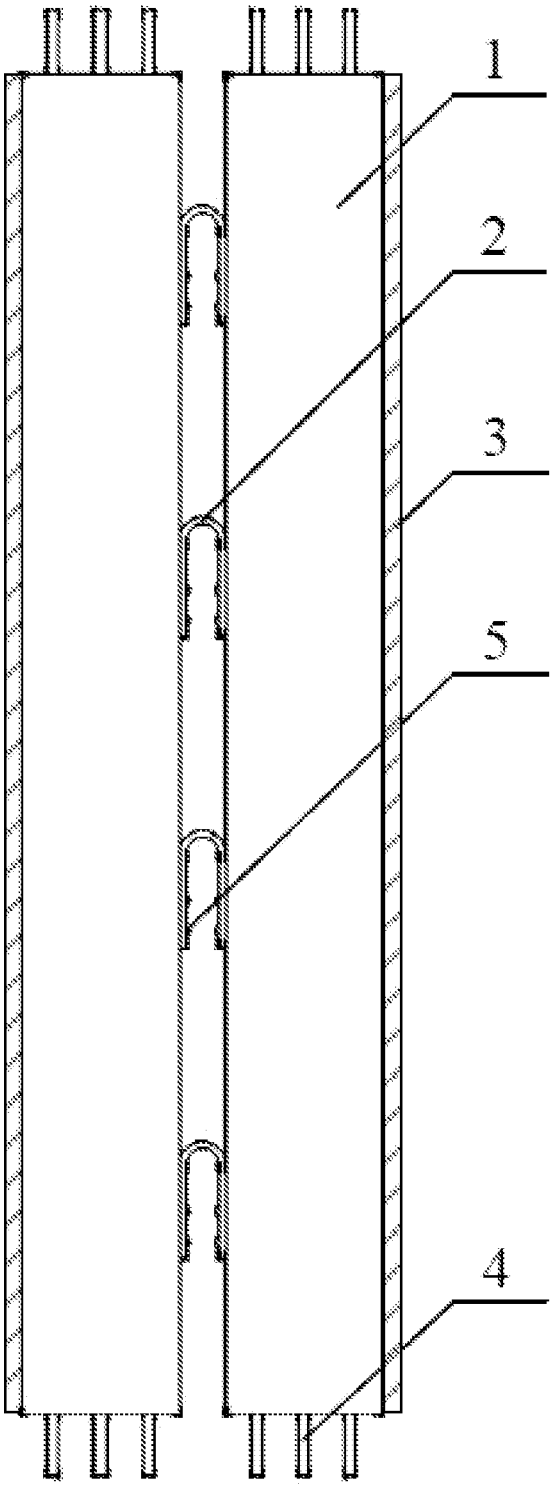
FIG. 4 illustrates front view of n-shape connected split column.
Figure 5:
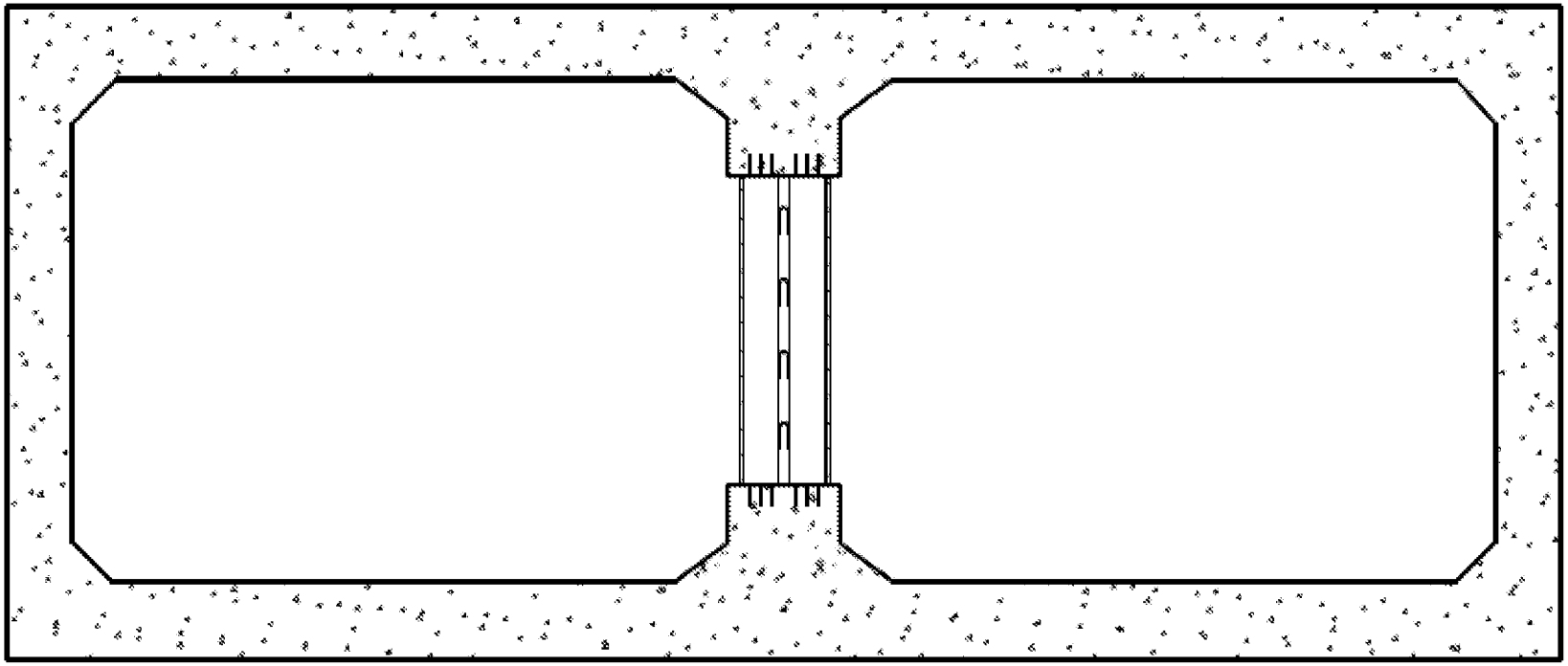
FIG. 5 illustrates one application of n-shape connected split column in the underground structure.

As is shown in FIG. 1-5, A kind of n-shape connected split column for an underground structure comprising: prefabricated reinforced concrete column (1), n-shape connector (2), exterior packaged steel sheet (3), reserved connecting reinforcement (4) and reserved high strength bolt (5); top of longitudinal reinforcement of prefabricated reinforced concrete column (1) are fully extended as reserved connecting reinforcement (4); reserved high strength bolt (5) is soldered on reinforcement cage of prefabricated reinforced concrete column (1); n-shape connector (2) connects with reserved high strength bolt (5) through its reserved bolt hole on both wings; exterior packaged steel sheet (3) is pasted on the exterior of prefabricated reinforced concrete column (1); coadjacent prefabricated reinforced concrete column and connection gap between them is overall packaged.

In this embodiment, the subject of prefabricated reinforced concrete column (1) is ordinary reinforced concrete column. It is prefabricated with suitable size from the reinforced concrete component processing plant and is transported to scene to assemble.

In this embodiment, during prefabrication process of prefabricated reinforced concrete column (1), top surface of longitudinal reinforcement are fully extended, its' stretching-length should be no less than 50 cm as reserved connecting reinforcement (4) to connect with top and bottom beam.

In this embodiment, during prefabrication process of prefabricated reinforced concrete column (1), 10 cm high strength bolt is soldered on reinforcement cage, after finishing of concrete pouring, stretching-length of high strength bolt extends from the side face of the reinforced concrete column should be no less than 5 cm as reserved high strength bolt (5).

In this embodiment, during prefabrication process of prefabricated reinforced concrete column (1), high strength bolt (5) is reserved on adjacent side faces, each 4 or more than 4 high strength bolt constitutes a bolt group, bolt group is distributed with equal interval along with height direction of prefabricated reinforced concrete column, interval ranges from 1 m-1.5 m.

In this embodiment, n-shape connector (2) is made of mild steel with low yield point; bolt hole is reserved on both wings of the n-shape connector (2), prefabricated reinforced concrete columns are connected through bolt group.

In this embodiment, exterior packaged steel sheet (3) is made of 1 cm-2 cm thick steel sheet, exterior packaged steel sheet (3) is pasted on the exterior of the prefabricated reinforced concrete column (1); coadjacent prefabricated reinforced concrete column and connection gap between them is overall packaged.

What is claimed is:

1. An n-shape prefabricated connective split column for underground structures, the split column comprising:

a prefabricated reinforced concrete column, an n-shape connector, an exterior packaged steel sheet, a reserved connecting reinforcement and a reserved high strength bolt; wherein:

top surfaces of longitudinal reinforcement of the prefabricated reinforced concrete column are fully extended as the reserved connecting reinforcement;

the reserved high strength bolt is soldered on a reinforcement cage of the prefabricated reinforced concrete column;

the n-shape connector, being shaped like letter "n" with two wings and a curvature connecting the two wings, connects with the reserved high strength bolt through reserved bolt holes on the two wings;

gaps are left between adjacent prefabricated reinforced concrete columns for placing the n-shape connectors the exterior packaged steel sheet is pasted on the exterior of the prefabricated reinforced concrete columns; and the prefabricated reinforced concrete columns and the gaps are wrapped together by the exterior packaged steel sheet.

2. The split column of claim 1, wherein the prefabricated reinforced concrete column is a reinforced concrete column, configured to be prefabricated with a suitable size from a reinforced concrete component processing plant and to be transported as well as assembled on site.

3. The split column of claim 1, wherein the top surfaces of longitudinal reinforcement of the prefabricated reinforced concrete column are fully extended during a prefabrication process, stretching-length of the prefabricated reinforced concrete column is not less than 50 cm for the reserved connecting reinforcement to be connected to top and bottom beams of the prefabricated reinforced concrete column.

4. The split column of claim 1, wherein a 10 cm high strength bolt is soldered to the reinforcement cage of the prefabricated reinforced concrete column during a prefabrication process of the prefabricated reinforced concrete column, and stretching-length of the 10 cm high strength bolt that extends from a side face of the reinforced concrete column is not less than 5 cm as the reserved high strength bolt after concrete pouring.

5. The split column of claim 1, wherein the reserved high strength bolt is reserved on adjacent side faces of the prefabricated reinforced concrete column during a prefabrication process of the prefabricated reinforced concrete column, at least four reserved high strength bolts constitute a bolt group, the bolt group is distributed with an equal interval along with a height direction of the prefabricated reinforced concrete column, and interval ranges are from 1 m to 1.5 m.

6. The split column of claim 1, wherein the n-shape connector is made of mild steel with a low yield point, the reserved bolt holes are reserved on the two wings of the n-shape connector, and the prefabricated reinforced concrete columns are connected through a bolt group.

7. The split column of claim 1, wherein the exterior packaged steel sheet is made of 1 cm to 2 cm thick steel sheet.

* * * * *